United States Patent [19]

Lard

[11] 4,302,008

[45] Nov. 24, 1981

[54] DEVICE FOR IMPROVING PHYSICAL FITNESS

[76] Inventor: Charles W. Lard, 35 Ridgewood Rd., West Hartford, Conn. 06107

[21] Appl. No.: 100,525

[22] Filed: Dec. 5, 1979

[51] Int. Cl.[3] ..... A63B 23/00

[52] U.S. Cl. ..... 272/117; 272/128; 272/DIG. 4; 272/124

[58] Field of Search ..... 272/1 R, 67, 76, 93, 272/116, 117, 122, 123, 124, 128, 126, 131, 135, 136, 142, 143; 273/26 B, 29 A, 72 R, 73 R, 73 H, 162 R, 170, 186 A; 73/379, 380; 145/2 R, 29 R, 61 R

[56] References Cited

U.S. PATENT DOCUMENTS

| | | | |
|---|---|---|---|
| 647,220 | 4/1900 | Courtney | 272/124 |
| 712,634 | 11/1902 | Aronstein | 272/76 X |
| 1,418,401 | 6/1922 | Schmidt | 272/93 X |
| 1,926,921 | 9/1933 | Smyley | 272/128 |
| 1,975,020 | 9/1934 | Sanford | 272/128 |
| 2,613,475 | 10/1952 | Mellor | 272/76 X |
| 2,772,887 | 12/1956 | Blake | 273/26 B X |
| 2,780,098 | 2/1957 | Maroth | 273/26 B |
| 3,006,646 | 10/1961 | Nanni | 272/124 X |
| 3,017,181 | 1/1962 | Sanders | 272/76 |
| 3,113,781 | 12/1963 | Guier | 273/26 B X |
| 3,113,782 | 12/1963 | Guier | 273/26 B X |
| 3,136,546 | 6/1964 | Connolly | 273/26 B |
| 3,545,121 | 12/1970 | Misko | 272/128 X |
| 3,572,706 | 3/1971 | Schroder | 273/26 B |
| 3,578,801 | 5/1971 | Piazza | 273/26 B |
| 3,677,553 | 7/1972 | Moore | 273/170 X |
| 3,810,620 | 5/1974 | Decker et al. | 273/73 H |
| 3,937,462 | 2/1976 | Kusmer | 272/116 X |
| 3,975,018 | 8/1976 | Walker | 273/186 A X |
| 4,026,548 | 5/1977 | Birdwell | 272/143 |
| 4,155,547 | 5/1979 | Savio et al. | 73/379 X |

*Primary Examiner*—Richard J. Apley

*Attorney, Agent, or Firm*—Prutzman, Kalb, Chilton & Alix

[57] ABSTRACT

A device for improving physical fitness includes an ax-like device which is swung in a chopping movement. The device includes a hollow handle which has an adjustable weighting system mounted therein. A bell and a spring mounted weight are mounted in the handle, and the weight impacts the bell when a desired chopping movement has been executed. The amount of force required to execute the desired chopping movement can be varied by varying the length of the spring.

5 Claims, 6 Drawing Figures

FIG. 1.
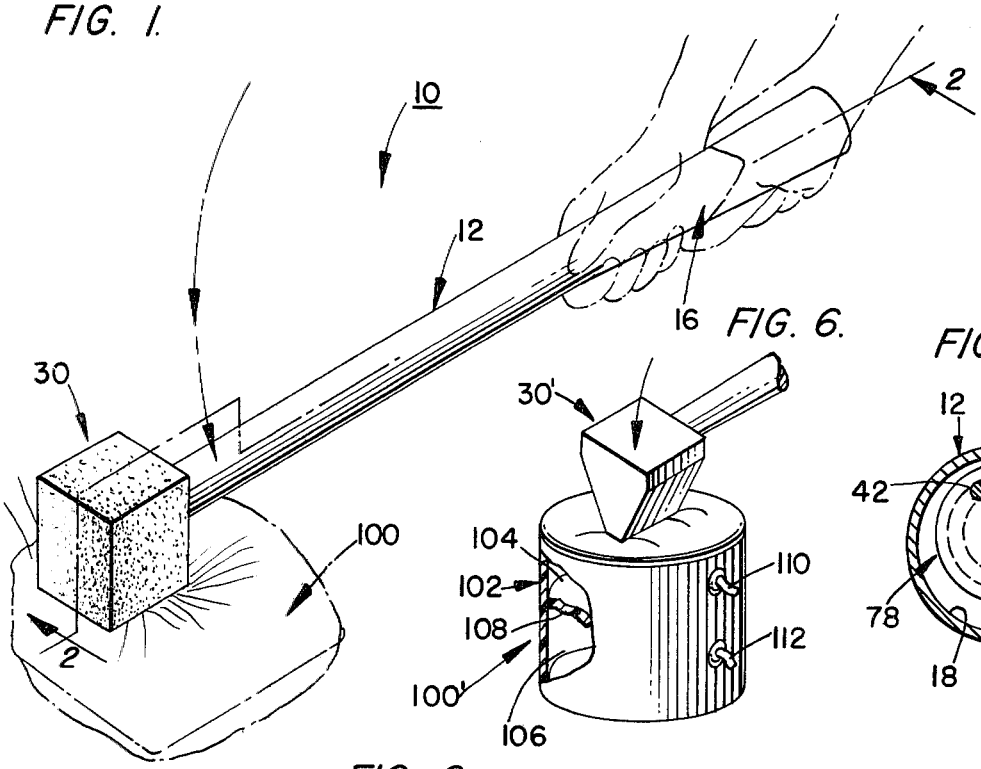
FIG. 6.
FIG. 3.
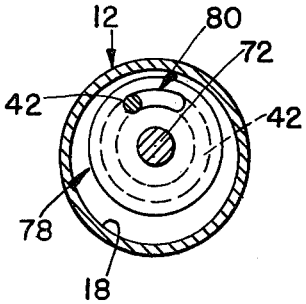
FIG. 2.
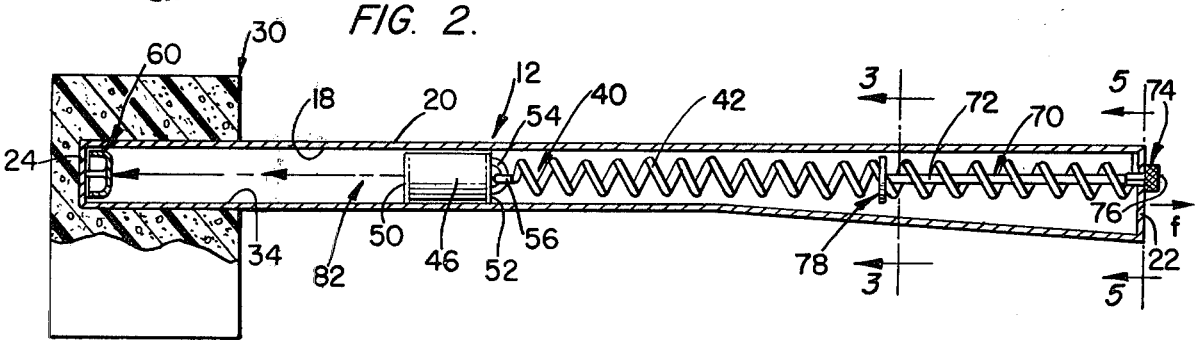
FIG. 4.
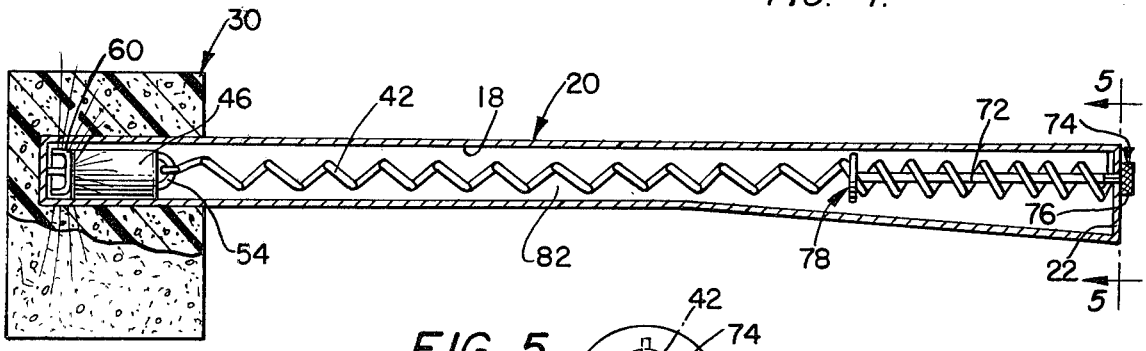
FIG. 5.
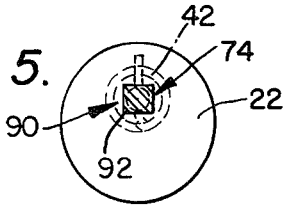

DEVICE FOR IMPROVING PHYSICAL FITNESS

BACKGROUND OF THE INVENTION

The present invention relates in general to exercise devices, and, more particularly, to muscle builders and toners. There are many exercise devices available on the market today. Examples of such exercise devices are dead weights, Universal Gyms ®, Nautilus ® equipment, and the like.

However, all of these known devices, while effective muscle builders and toners, do not effectively relax the user while building and toning muscles. Furthermore, the weight equipment does not fully develop timing and muscle coordination as well as building and toning the muscles.

Accordingly, there is need for a muscle building and toning device which also relaxes a user while helping the development of a user's timing and muscle coordination.

SUMMARY OF THE INVENTION

The device embodying the teachings of the present invention permits a user to build and tone his muscles, while at the same time relaxing him and developing his timing and muscle coordination.

The device includes an elongate handle with an impact head on one end thereof, and which is in the form of an ax, or sledgehammer, or the like. The device has an adjustable weighting system mounted inside the handle, and is swung in an ax-like chopping movement. The impact head strikes an impact cushion or similar energy absorber, like a rubber log, at the end of a stroke.

The weighting system includes a free sliding weight attached to a spring and a bell mounted in the handle to be impacted by the weight at or near the end of the stroke. A spring force adjuster controls the amount of swing-induced force required to cause the weight to impact the bell. By adjusting the force required to ring the bell, a user can control the intensity of his workout.

The ax-like swinging or chopping motion builds and tones a user's arm, back, chest, shoulder, stomach and leg muscles very effectively. Additionally, this motion must be properly timed so that a user's timing and muscle coordination are also developed.

The striking of the impact cushion also mentally relaxes the user during his workout.

A swing-force gauge can be used to further control the workout. Repeated swinging in a time sequence can be used to produce a workout regimen if so desired.

OBJECTS OF THE INVENTION

It is, therefore, a main object of the present invention to provide a device for improving physical fitness which also relaxes a user during a workout.

It is another object of the present invention to provide a muscle builder and toner which also develops muscle timing and coordination for a user.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 1 is a perspective of a device for improving physical fitness embodying the teachings of the present invention.

FIG. 2 is a cutaway elevation view of a device for improving physical fitness embodying the teachings of the present invention in the in-stroke condition.

FIG. 3 is a view taken along line 3—3 of FIG. 2.

FIG. 4 is a cutaway elevation view of a device for improving physical fitness embodying the teachings of the present invention in the end-of-stroke condition.

FIG. 5 is a view taken along line 5—5 of FIG. 2.

FIG. 6 is a perspective view of an alternative embodiment of the device embodying the teachings of the present invention.

DETAILED DESCRIPTION OF THE INVENTION

Shown in FIG. 1 is an exercise device 10 used for improving physical fitness and for building and toning muscles, such as arm, shoulder, abdomen, back and leg muscles. The device 10 resembles an ax or a sledgehammer, or the like, and is swung repeatedly in an ax-like chopping, or sledgehammer-like movement. The repeated swings can be performed on a timed basis, or the like, to carry out an exercise program, if so desired. The movement includes bringing the device 10 up over a user's head, and swinging that device downwardly toward a user's feet. Various methods of exercise and exercise regimens will occur to those skilled in the art from the ensuing disclosure.

The device 10 includes an elongate handle 12 having an enlarged hand grip end 16 and which is shaped in a manner which is similar to an ax-handle. The handle 12 is hollow, as best shown in FIGS. 2 and 4, and has a bore 18 defined therein by handle wall 20 and handle ends 22 and 24.

An impact head 30 is securely mounted on the handle at the end thereof remote from the hand grip portion. The head 30 in the preferred construction is cubical in shape and has a blind-ended bore 34 defined therein to receive the handle. Preferably, the head 30 is formed of a polyfoam-like material which will absorb the force of an impact to reduce or prevent such impact force from being transmitted to a user, but other materials can be used without departing from the scope of the present disclosure. As shown in FIGS. 2 and 4, the bore 18 is slightly off-center with respect to the head 30 so that the head is downwardly weighted in an in-use orientation, such as that shown in FIG. 1.

As shown in FIGS. 2 and 4, a weighting system 40 is located within the bore 18. The weighting system 40 is used to set the desired swing weight of the device 10 for carrying out an exercise program.

The weighting system 40 includes a helical coil tension spring 42 attached at one end thereof to end 22 on the inside surface of that end, and extending axially of the handle. A cylindrical weight 46 is axially oriented within the bore 18 and is sized to be freely slidable within that bore. The weight 46 includes a front end 50 and a rear end 52, and a cleat 54 is mounted in the rear end of the weight. The spring 42 has an eye 56 which is attached to the cleat and, as will be discussed below, resists movement of the weight towards the impact head 30.

An impact bell 60 is mounted in the bore 18 on the handle end 24 to be axially aligned with the weight 46.

The bell 60 is of the chime-type which rings upon being impacted.

A spring adjustment means 70 is mounted on the handle end 22 and includes an elongate rod 72 extending axially within the bore 18 and having an adjustment knob 74 on one end thereof. The rod extends outwardly of the bore 18 through the handle end 22, and the knob 74 is located outside the handle. In a preferred embodiment, the knob has knurling 76 on the outer periphery thereof. As will be discussed below, the knob 74 is rotatable, and the rod 72 is mounted on the knob for rotation therewith.

A spring adjustment disc 78 is mounted on the end of the rod which is located within the bore 18. The disc 78 is mounted on the rod 72 for rotation therewith, and thus, rotation of the knob 74 rotates the disc in the direction of knob rotation.

As best shown in FIG. 3, the disc is generally circular in peripheral outline and has an outer diameter which is smaller than the inner diameter of the handle so that the disc can be rotated within that handle.

The disc is annular and the rod 72 is firmly affixed thereto at or near the center thereof. An arcuate spring receiving slot 80 is defined in the disc to have a radius of curvature centered at the center of the disc, which is coincident with the central longitudinal axis of the rod 72. The knob 74 is also centered on the rod longitudinal centerline. Thus, rotation of the knob 74 about the center thereof rotates the slot 80 about the center of the disc 78.

As shown in FIGS. 2–4, the spring 42 extends through the slot 80 and contacts the periphery of that slot. As shown in these figures, the adjustment means 70 is mounted off of the longitudinal centerline of the bore 18 so that rotation of the knob 74 causes the slot 80 to move eccentrically about the longitudinal centerline of the bore 18. The spring 42 is positioned to have the longitudinal centerline thereof concentric with the longitudinal centerline of the bore narrow fore portion 82 as shown in FIGS. 2 and 4. Therefore, rotation of the knob 74, which is fixed on the handle 22, causes corresponding rotation of the disc 78 about the rod centerline and eccentric rotation of the slot 80 about the longitudinal centerline of the spring. Such eccentric rotation of the disc with respect to the spring longitudinal centerline results in a threading movement of the disc with respect to the spring.

As the disc is fixed via the rod and knob, and the spring is yieldable, such threading action causes the spring to be longitudinally extended on one side of the disc and to be longitudinally shortened on the other side of the disc. For example, clockwise rotation of the knob 74 can be used to reduce the length of the spring located between the disc and the weight 46 by forcing some of the spring behind the disc. The amount of force required to ring the bell is inversely proportional to the length of the spring located between the weight and the disc, so that force is increased by shortening the spring located between that weight and disc, and vice versa.

Additionally, as shown in FIG. 5, a locking mechanism 90 fixes the position of the disc 78 relative to the handle so that the desired spring tension will be maintained during the exercise session. The preferred form of the locking mechanism includes a trunk section 92 which is partially cylindrical and partially polygonal. The trunk section is accommodated in a polygonal hole defined through end 22, and can include a biasing spring if so desired. When the disc 78 is to be rotated, the knob 74 is pulled away from the handle in the direction of arrow f in FIG. 2 to position the cylindrical trunk portion in the polygonal hole and the disc rotated using the knob. To lock the disc in position, the polygonal trunk portion is positioned in the polygonal hole so that the edges of the trunk portion engage the edges of the hole portion thereby preventing rotation of the knob and the disc.

As can be seen in FIGS. 1 and 4, the device 10 is used by grasping the handle and swinging the device in an ax-like chopping movement so that the impact head 30 strikes an impact absorber cushion 100. The swinging movement of the device causes the weight 46 to move toward the bell against the yieldable force of the spring 42. The swinging movement causes the weight to move near the bell, and the jolting of the device caused by the impact of the head 30 on the cushion 100 causes the weight to impact the bell, thereby ringing that bell, as indicated in FIG. 4.

As can be seen in FIG. 4, the spring portion located between the disc and the handle end 22 does not extend during the chopping movement of the device, whereas the spring portion located between the disc and the weight does so extend.

The amount of force required to extend the spring far enough to permit the weight to contact the bell depends on the spring constant as well as the relaxed length of the spring between the weight and the disc. Thus, the amount of swinging force required to ring the bell can be adjusted by rotating the adjustment knob 74 to set the length of the spring located between the disc 78 and the weight. Thus, an exercise program can be controlled by adjusting the weight system 40 via the adjustment knob 74.

An alternative embodiment of the present device is shown in FIG. 6, wherein an impact head 30' is shaped similar to an ax head. An impact absorber 100' includes an inflatable cushion 102 having a plurality of chambers 104 and 106 separated by a gland 108. Each chamber has an inflation valve 110 and 112, respectively, and thus a two level cushion is formed. The lower level of the cushion, formed by chamber 106 in FIG. 6, can act as a safety chamber in case top chamber 104 bursts, or can act as a calibration chamber, or the like. The impact cushion 30' can also be shaped to simulate a log, if so desired.

A further alternative embodiment of the present device can include a calibration gauge or scale located at or near the knob so that a user can set a desired length of the spring and appropriately increase or decrease the spring force desired.

As will be evident from the above description, a user can exercise and tone his muscles by carrying out a program of repeated ax-like chopping movements, and by suitably increasing and/or decreasing the amount of force required to ring the bell during the program, can effectively control his exercise program.

Preferably, the head 30 is 6 inches×8 inches×4 inches and the handle is 4 inches in outer diameter at the end adjacent the head, and 6 inches in outer diameter adjacent end 22. The handle is preferably 29 inches in length.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. Physical fitness training means comprising a weight swinging device for physical fitness training having an elongated handle with a longitudinally extending bore and adapted to be held at one end of the handle for swinging the device, an impact head mounted on the other end of the handle for being swung with the handle, a weighting system comprising a weight reciprocable within said bore and shiftable in one direction toward the impact head by swinging the device, and yieldable means within said handle bore attaching said weight to said handle to restrain movement of the weight in said one direction when the device is swung, a bell mounted in said bore operable for signalling when said weight has shifted a predetermined distance in said one direction, and adjusting means connected to said yieldable means for controlling the amount of force required to shift the weight said predetermined distance in said one direction for controlling the required swinging rate, and therefore the associated level of physical fitness training, for operating the bell.

2. Physical fitness training means comprising a weight swinging device for physical fitness training having an elongated handle with a longitudinally extending bore and adapted to be held at one end of the handle for swinging the device, an impact head mounted on the other end of the handle for being swung with the handle, a weighting system comprising a weight reciprocable within said bore and shiftable in one direction toward the impact head by swinging the device, and yieldable means within said handle bore attaching said weight to said handle to restrain movement of the weight in said one direction when the device is swung, and adjusting means connected to said yieldable means for controlling the amount of force required to shift the weight said predetermined distance in said one direction, said yieldable means including a helical coil spring attached at one end thereof to said handle and at the other end thereof to said weight, said adjusting means including a rod within said handle bore attached at one end thereof to said handle, a disc fixed to said rod at the other end thereof, said disc having a spring receiving slot defined therein through which the coil spring passes, an adjusting knob mounted on said one end of the rod and located outside said bore, said disc and said rod being fixed for rotation with said adjusting knob so that rotation of said adjusting knob rotates said disc with respect to said spring for changing the length of spring between said disc and said weight, and locking means to prevent rotation of said disc during exercise.

3. Physical fitness training means comprising a weight swinging device for physical fitness training having an elongated handle with a longitudinally extending bore and adapted to be held at one end of the handle for swinging the device, an impact head mounted on the other end of the handle for being swung with the handle, a weighting system comprising a weight reciprocable within said bore and shiftable in one direction toward the impact head by swinging the device, and yieldable means within said handle bore attaching said weight to said handle to restrain movement of the weight in said one direction when the device is swung, and adjusting means connected to said yieldable means for controlling the amount of force required to shift the weight said predetermined distance in said one direction, and an impact cushion which is adapted to be struck by said impact head.

4. Physical fitness training means according to claim 3 wherein said impact head is formed of an impact absorbing material and the impact cushion is an inflatable cushion.

5. A method of physical fitness training comprising the steps of providing a fixed impact target, providing an ax-like exercise device having an elongated handle with a longitudinally extending bore and adapted to be held at one end of the handle for swinging the device, an impact head mounted on the other impact end of the handle for being swung by the handle in an ax-like chopping movement to impact the fixed impact target, and an adjustable signalling system comprising a weight reciprocable within said handle bore and shiftable in one direction toward the impact end when the exercise device is swung, signalling means operable for signalling when said weight has shifted in said one direction to a predetermined position, and adjustable means mounted on the handle for controlling the amount of force required to shift the weight in said one direction for operating the signalling means, thereby for controlling the required swinging rate and the associated level of physical fitness training for operating the signalling means; the method further comprising the steps of swinging the ax-like exercise device in an ax-like chopping movement to impact the head of the exercise device against the fixed impact target, and adjusting the adjustable means to control the swing rate, and therefore the associated level of physical fitness training, required for operating the signalling means.

* * * * *